US010378226B2

(12) United States Patent
Shpringer et al.

(10) Patent No.: US 10,378,226 B2
(45) Date of Patent: Aug. 13, 2019

(54) POOL COVER WINDING SYSTEM USING WATER-POWERED PISTON MOTOR

(75) Inventors: Jacob Shpringer, Beit Hanania (IL); Jean-Paul Villacampa, Alenya (FR); Ehud Nagler, Kiryat Tivon (IL)

(73) Assignee: MAYTRONICS LTD, Kibutz Yizrael ( * ) Notice: Subject to any disclaimer, the term of this patent is extended or adjusted under 35 U.S.C. 154(b) by 1582 days.

(21) Appl. No.: 13/275,359

(22) Filed: Oct. 18, 2011

(65) Prior Publication Data

US 2013/0092779 A1 Apr. 18, 2013

(51) Int. Cl.
*E04H 4/08* (2006.01)

(52) U.S. Cl.
CPC ..... *E04H 4/082* (2013.01)

(58) Field of Classification Search
USPC ..... 4/502
See application file for complete search history.

(56) References Cited

U.S. PATENT DOCUMENTS

| | | | | |
|---|---|---|---|---|
| 3,885,255 | A * | 5/1975 | Vorbach et al. | 4/502 |
| 4,675,922 | A * | 6/1987 | Colin et al. | 4/502 |
| 5,184,357 | A * | 2/1993 | Last | 4/502 |
| 5,327,590 | A * | 7/1994 | Last | 4/502 |
| 2001/0034906 | A1* | 11/2001 | Last | 4/502 |
| 2002/0046817 | A1* | 4/2002 | Last | 160/133 |
| 2010/0170032 | A1* | 7/2010 | Sproatt et al. | 4/502 |
| 2011/0163249 | A1* | 7/2011 | Meikle et al. | 251/65 |

* cited by examiner

*Primary Examiner* — Lauren A Crane
(74) *Attorney, Agent, or Firm* — RECHES Patents

(57) ABSTRACT

A pool cover winding system has first and second end supports rotatably supporting a shaft for receiving a pool cover wound around it. A bidirectional piston motor operates under control of a valve arrangement connecting a source of water pressure to a first inlet to generate rotation in a first direction for winding a pool cover around the shaft, and to a second inlet to generate rotation in a second direction for unwinding a pool cover from the shaft.

2 Claims, 14 Drawing Sheets

POOL COVER WINDING SYSTEM USING WATER-POWERED PISTON MOTOR

FIELD AND BACKGROUND OF THE INVENTION

The present invention relates to covers for pools and, in particular, it concerns a pool cover winding system which uses a water-powered piston motor.

Removable covers are often provided for private and commercial swimming pools. Such covers serve one or more purposes such as: preventing dirt and other objects from entering the pool, reducing evaporation and heat loss, and reducing the danger of drowning. Such covers are often made from a sequence of buoyant slats that are flexibly interconnected. The cover is typically wound onto a rotatable shaft for storage when not in use.

Manual winding of the cover for deployment over the pool or for retraction onto the shaft is often time consuming and difficult. It has been proposed to provide an electric motor to wind-in and wind-out the cover. However, installation of electrical equipment in or around a pool presents considerable safety concerns and maintenance problems.

There is therefore a need for a pool cover winding system which uses a water-powered piston motor.

SUMMARY OF THE INVENTION

The present invention is a pool cover winding system which uses a water-powered piston motor.

According to the teachings of the present invention there is provided, a pool cover winding system comprising: (a) a shaft for receiving a pool cover wound around it; (b) first and second end supports configured for supporting the shaft rotatably; (c) a bidirectional piston motor mechanically linked to the first end support and the shaft, the bidirectional piston motor being configured to operate under fluid pressure supplied to a first inlet to generate rotation in a first direction for winding a pool cover around the shaft, and to operate under fluid pressure supplied to a second inlet to generate rotation in a second direction for unwinding a pool cover from the shaft; and (d) a valve arrangement for selectively connecting a source of water pressure to each of the first and second inlets.

According to a further feature of an embodiment of the present invention, the valve arrangement is configured to selectively assume: (a) a first state in which the source of water pressure is connected to the first inlet and the second inlet is connected to a drainage line; and (b) a second state in which the source of water pressure is connected to the second inlet and the first inlet is connected to the drainage line, wherein the drainage line is deployed to deliver water exiting from the bidirectional piston motor to a drain or to the pool.

According to a further feature of an embodiment of the present invention, the valve arrangement comprises at least one electrically actuated valve, the system further comprising a battery powered controller for selectively actuating the at least one electrically actuated valve, the controller being configured to operate from battery power without connection to an external electrical power supply.

According to a further feature of an embodiment of the present invention, the electrically actuated valve includes a latching solenoid.

According to a further feature of an embodiment of the present invention, there is also provided an encoder deployed for sensing rotation of the shaft relative to at least one of the first and second end supports, wherein the controller is operatively connected to the encoder and responsive to an output of the encoder to interrupt flow to the bidirectional piston motor when the shaft has turned through a given angle corresponding to a fully extended or fully retracted position of the pool cover.

According to a further feature of an embodiment of the present invention, the shaft is at least partially hollow, and wherein the bidirectional piston motor is deployed primarily within the shaft.

According to a further feature of an embodiment of the present invention, the bidirectional piston motor is fixed within the shaft so as to rotate together with the shaft, and wherein the motor includes an output drive gear deployed to engage a fixed gear associated with the first end support so as to drive the motor and the shaft to rotate relative to the first end support.

According to a further feature of an embodiment of the present invention, the first end support comprises an axial water feed associated with the valve arrangement and extending into the bidirectional piston motor, the axial water feed including a first water supply lumen terminating in a first outlet forming a rotatable fluid flow connection with the first inlet of the motor and a second lumen terminating in a second outlet forming a rotatable fluid flow connection with the second inlet of the motor, wherein the second outlet is axially spaced from the first outlet.

According to a further feature of an embodiment of the present invention, the first and second end supports are configured to support the shaft at a level above a pool.

According to a further feature of an embodiment of the present invention, the first and second end supports are configured to support the shaft immersed within a pool.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a pool cover winding system which uses a water-powered piston motor.

The principles and operation of pool cover winding systems according to the present invention may be better understood with reference to the drawings and the accompanying description.

Figure 1:
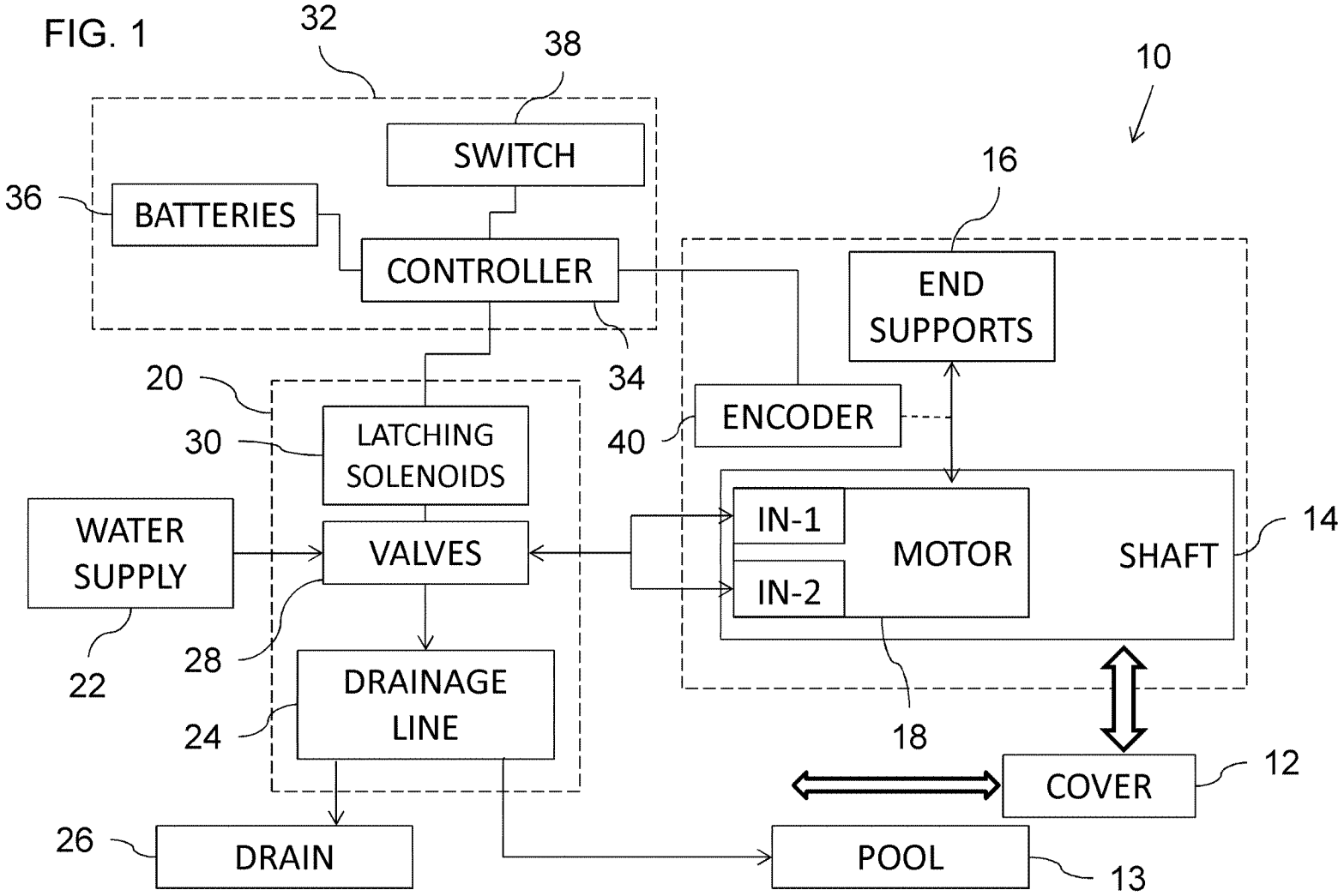
FIG. 1 is a schematic block diagram of an embodiment of a pool cover winding system constructed and operative according to an embodiment of the present invention.

Referring now to the drawings, FIG. 1 illustrates an overview of a pool cover winding system, generally designated 10, constructed and operative according to an embodiment of the present invention, for winding a pool cover 12 around a shaft 14 for storage and for redeploying the cover to cover a pool 13, for example, a swimming pool (not shown).

In general terms, winding system 10 includes first and second end supports 16 rotatably supporting shaft 14 for receiving pool cover 12 wound around it. A piston motor 18, mechanically linked to a first end support 16*a* and shaft 14, is configured to operate under fluid pressure to turn shaft 14. Most preferably, piston motor 18 is a bidirectional motor configured to operate under fluid pressure supplied to a first inlet "IN-1" to generate rotation in a first direction for winding pool cover 12 around shaft 14, and to operate under fluid pressure supplied to a second inlet "IN-2" to generate rotation in a second direction for unwinding a pool cover from the shaft. A valve arrangement 20 is deployed for selectively connecting a source of water pressure 22 to each of the first and second inlets.

At this stage, it will already be apparent that the present invention provides significant advantages. Specifically, in contrast to systems employing electrical motors, the system of the present invention typically does not require any connection to an external source of electrical power, with any electrical circuitry used for control elements being powered by batteries, thereby avoiding the safety issues of electrical installation beside or submerged in the pool. At the same time, the use of a piston motor provides an effective solution to generate sufficient power for winding even a relatively heavy pool cover based on common domestic water supply pressure of 2-3 atmospheres in a manner that would not be feasible using common impeller-type water-driven mechanisms. These and other advantages of the present invention will become clearer from the following description and accompanying drawings.

It should be noted that the present invention is applicable both to above-water deployment of the pool cover winding system and to below-water deployment. FIGS. 2A-3B illustrate an implementation in which end supports 16*a* and 16*b* are configured to support shaft 14 at a level above a pool. FIGS. 4A-5B illustrate an implementation in which end supports 16*a* and 16*b* are configured to support shaft 14 immersed within a pool. Unless otherwise specified, the remaining features of the present invention described herein are typically equally applicable to under-water and over-water implementations.

Valve arrangement 20 is preferably configured to operate piston motor 18 in open-loop, assuming a first state in which water pressure source 22 is connected to first inlet IN-1 and second inlet IN-2 is connected to a drainage line 24, and a second state in which water pressure source 22 is connected to second inlet IN-2 and first inlet IN-1 is connected to drainage line 24. Drainage line 24 is deployed to deliver water exiting from the bidirectional piston motor either to a drain 26 or into pool 13.

Figure 13B:
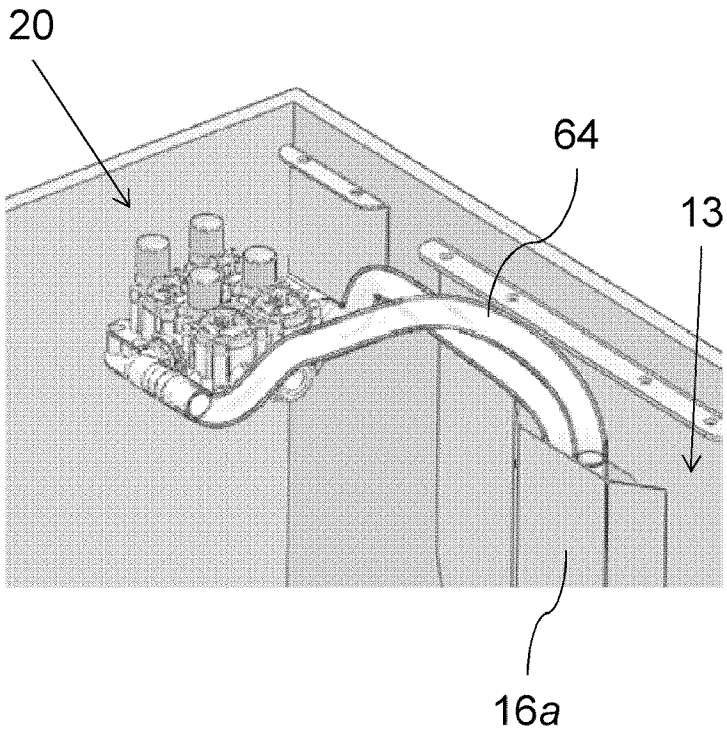
FIG. 13B is a schematic isometric view illustrating deployment of a valve assembly for the pool cover winding system of FIG. 4A.
Figure 13A:
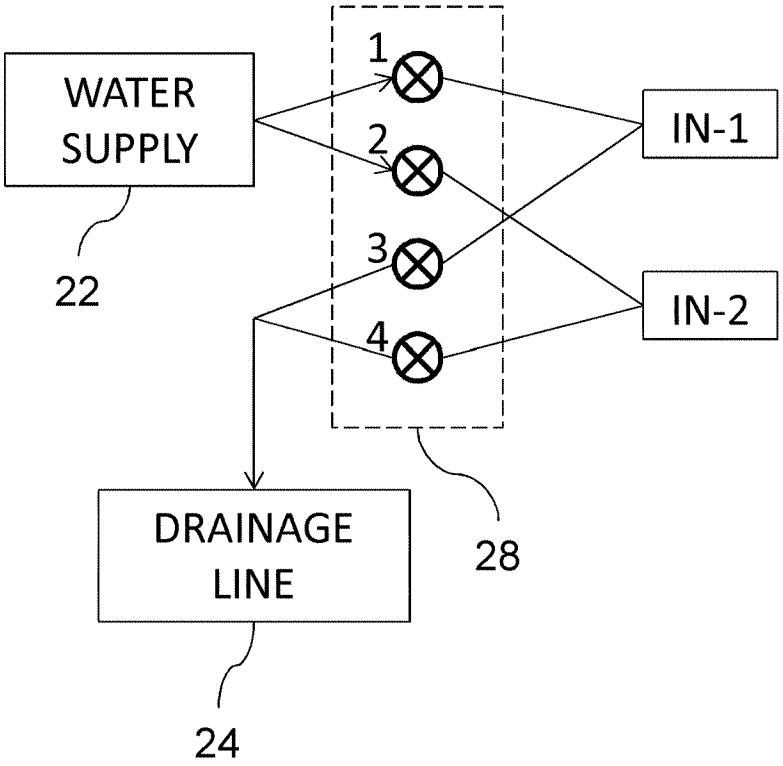
FIG. 13A is a schematic representation of the connections of a set of valves according to one implementation for operating the winding system of the present invention.

In one preferred but non-limiting implementation, valve arrangement 20 achieves the above-mentioned connections by use of a set of valves 28 including four valves, illustrated schematically in FIG. 13A, numbered 1-4. In the first aforementioned state, valves 1 and 4 are open and valves 2 and 3 are closed, providing pressure to IN-1 and draining IN-2, while in the second aforementioned state, valves 2 and 3 are open while valves 1 and 4 are closed, providing pressure to IN-2 and draining IN-1. Although this arrangement is believed to be advantageous due to its low cost and simplicity, it should be understood that alternative arrangements employing five or more valves, or employing 3-state valves to switch between the difference connection states, may also be used.

Valves 28 are preferably electrically actuated valves, preferably operated by a corresponding set of solenoids. In order to minimize electrical power usage to ensure a long life cycle for a battery-powered control system, latching solenoids 30 are preferably used. Latching solenoids (also known as bistable solenoids) employ an arrangement of permanent magnets or any other suitable "latch" arrangement to render the deployed state of the solenoid (in this case, corresponding to the open state of the valve) stable without requiring maintaining an actuating current. As a result, operation of the motor merely requires an initial actuation pulse to displace the corresponding solenoids to open the required valves, and then another pulse to release the latching effect at the end of the motion. It should be noted that a purely mechanical implementation, employing manually operated valves for controlling motion of the winding mechanism in each direction, also falls within the scope of the present invention.

Figure 14:
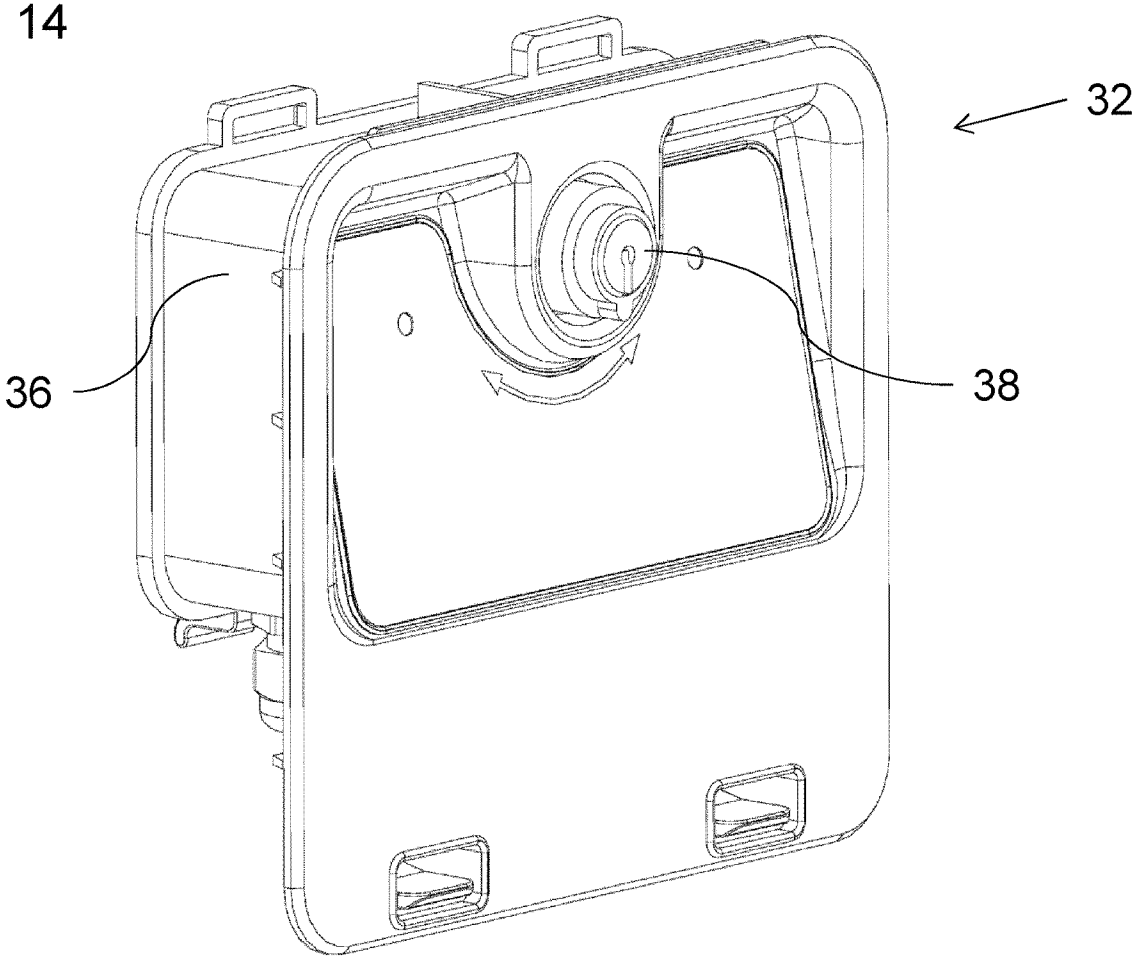
FIG. 14 is an isometric view of a controller unit for use in an embodiment of the present invention.

As already mentioned, it is a particularly preferred feature of certain embodiments of the present invention that the winding system 10 is controlled by a battery powered control unit 32, without connection to any external source of electrical power. To this end, control unit 32 preferably includes a battery powered controller 34, including suitable electronics, for selectively actuating valve arrangement 20. Controller 34 is preferably powered by connection to a set of batteries 36, and receives input from one or more switch 38 through which a user operates the winding system. Control unit 32 is preferably implemented as a combined, water-sealed unit deployed at a convenient location for actuation by the user, such as is illustrated in FIG. 14. In above-pool implementations, the unit may optionally be integrated with one of the end supports of the winding system.

Controller 34 may be implemented using any suitable electronics, typically in the form of a dedicated integrated chip containing appropriate logic circuitry and generating suitable actuation signals to actuate the solenoids. Alternatively, a general purpose processor may be used operating under suitable software or firmware may be used, all as will be clear to a person ordinarily skilled in the art.

Depending on the location of deployment, switch 38 may advantageously be implemented as a key-operated switch for safety reasons, as illustrated in FIG. 14. Operation in the retraction winding direction preferably continues automatically once initiated until the pool cover reaches its fully wound position. In the unwinding/deployment direction, operation preferably occurs only while the switch is actively operated against a resilient resistance, thereby assuring the physical presence and attention of an operator during closing of the cover, for safety reasons.

It will be noted that the subdivision of components as shown in FIG. 1 between control unit 32 and valve arrangement 20 is somewhat arbitrary. For example, optionally, batteries 36 and controller 34 may be integrated in the same housing as valve assembly 20, either together with switch 38 or with switch 38 located separately at a more accessible location.

Winding system 10 preferably also includes an encoder 40 deployed for sensing rotation of shaft 14 relative to one of the end supports 16. Encoder 40 may be any type of encoder suitable for tracking the rotation of shaft 14 over multiple rotations. In one preferred but non-limiting implementation, a number of magnets, for example, 12, are spaced around the periphery of the end of shaft 14, and corresponding sensors on the end support sense motion of the magnets. Encoder 40 is interconnected so as to provide its output signals to controller 34 which tracks the position of shaft 14 through multiple turns between predefined fully wound and fully deployed positions, defined during installation. The controller is configured to interrupt water flow to the bidirectional piston motor when the shaft has turned through the given angle corresponding to reaching the fully extended or fully retracted position of the pool cover.

Parenthetically, it should be noted that the piston motor of the present invention also provides highly effective locking of shaft 14 against unintended rotation while the control valves are closed, thereby preventing gradual unwinding of the cover without requiring any separate locking mechanism.

Turning now to further details of certain preferred structural implementations of the present invention, certain particularly preferred embodiments of the present invention employ a shaft 14 that is at least partially hollow, with piston motor 18 deployed primarily within the hollow shaft. This results in a particularly compact and aesthetic system, without the need for external motor installation. It should be noted, however, that alternative implementations with an external motor, located either in a side support (for above-pool installation) or in an adjacent dry pit (for underwater installation) also fall within the broad scope of the present invention.

In a particularly preferred set of non-limiting embodiments, piston motor 18 is fixed within shaft 14 so as to rotate together with the shaft. In this case, motor 18 preferably includes an output drive gear 42 (FIGS. 6-9B) deployed to engage a fixed gear 44 (FIGS. 3B, 5B, 9A and 9B) associated with one of the end supports 16 so as to drive motor 18 and shaft 14 to rotate relative to the end support 16.

Figure 2A:
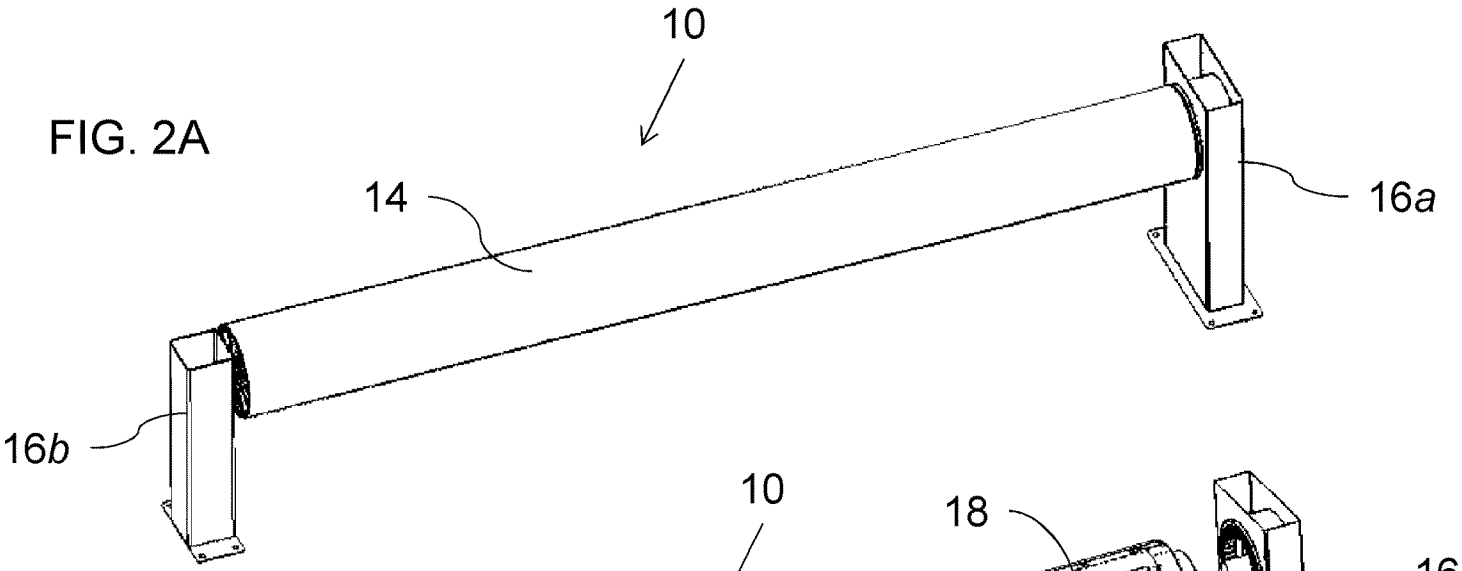
FIG. 2A is a schematic isometric view of a pool cover winding system, constructed and operative according to an embodiment of the present invention, including two end supports for above-water deployment.
Figure 2B:
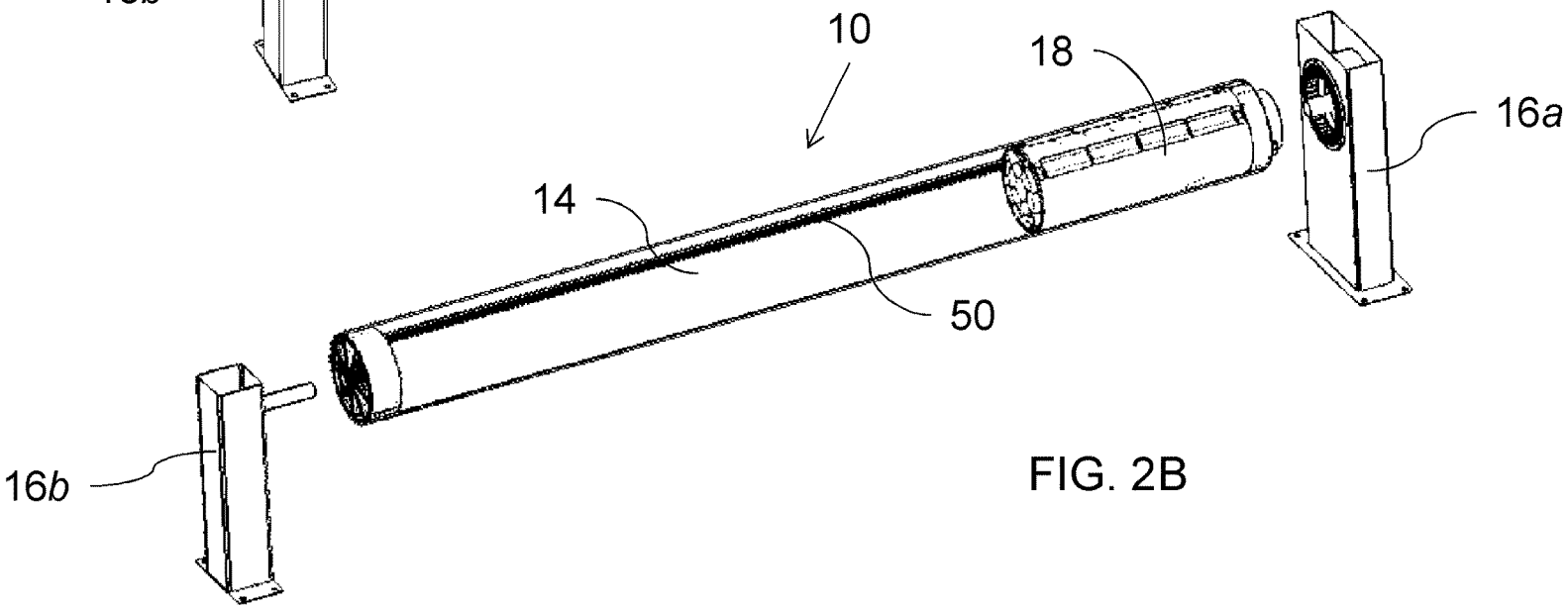
FIG. 2B is a partially cut-away and disassembled isometric view similar to FIG. 2A showing a water-powered piston motor deployed within a hollow shaft of the winding system.
Figure 3B:
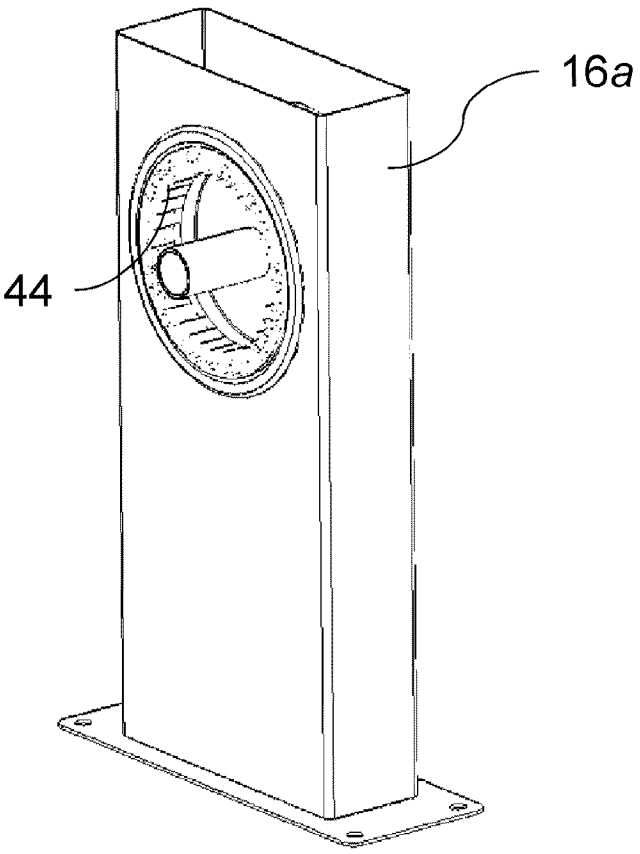
FIGS. 3A and 3B are enlarged isometric views of the end supports of FIG. 2A.
Figure 3A:
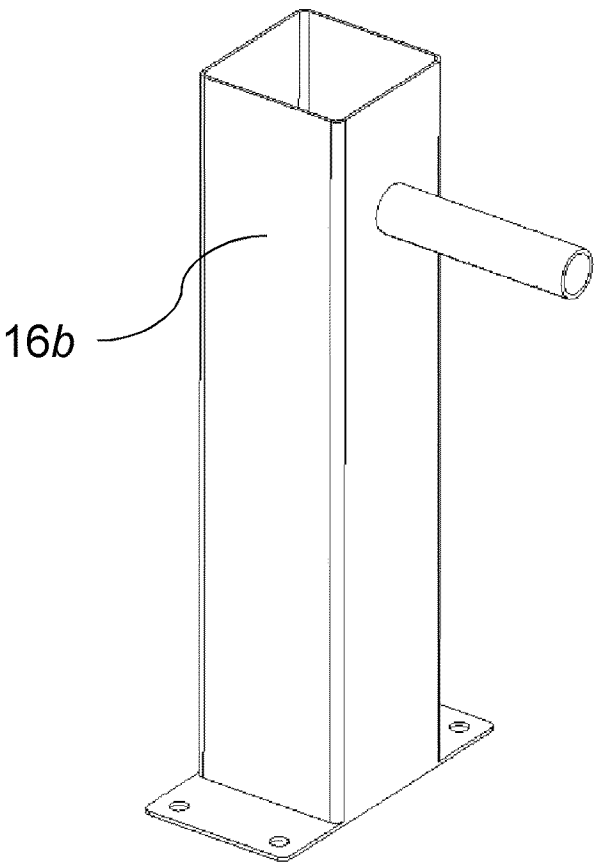
Figure 4A:
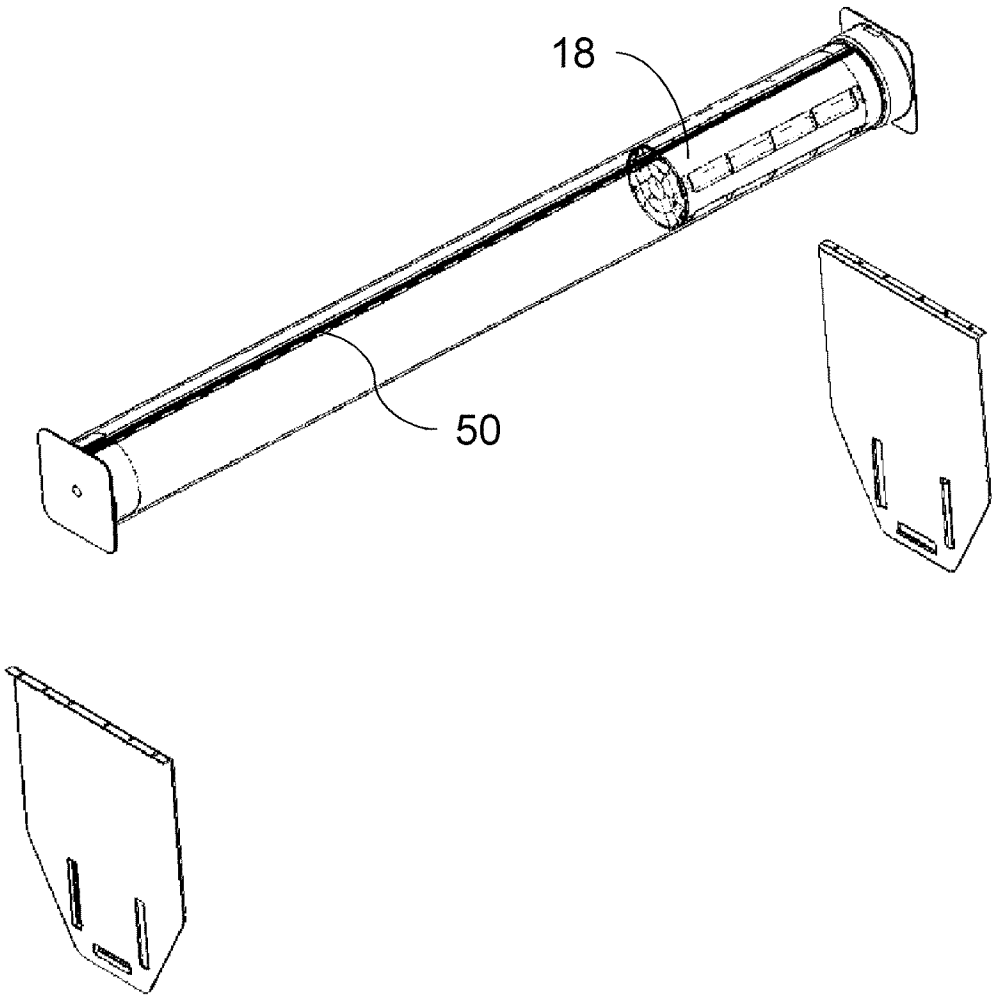
FIG. 4A is a partially cut-away and disassemble view of a pool cover winding system, constructed and operative according to an embodiment of the present invention, including two end supports for underwater deployment.
Figure 5B:
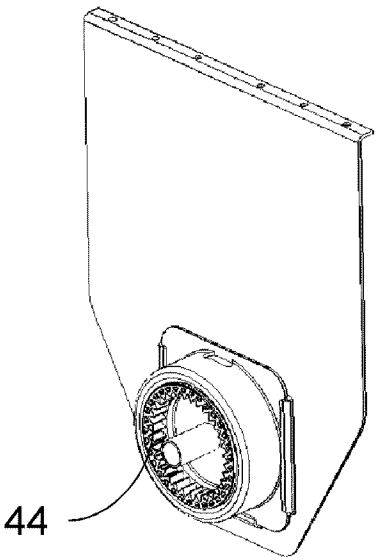
FIGS. 5A and 5B are enlarged isometric views of the end supports of FIG. 4A.
Figure 5A:
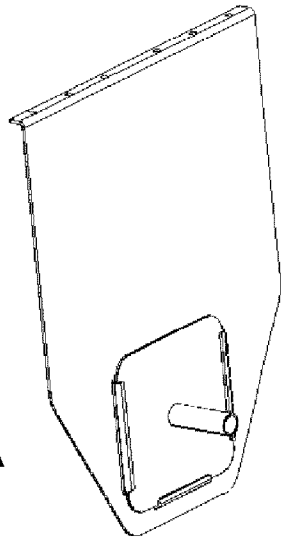
Figure 4B:
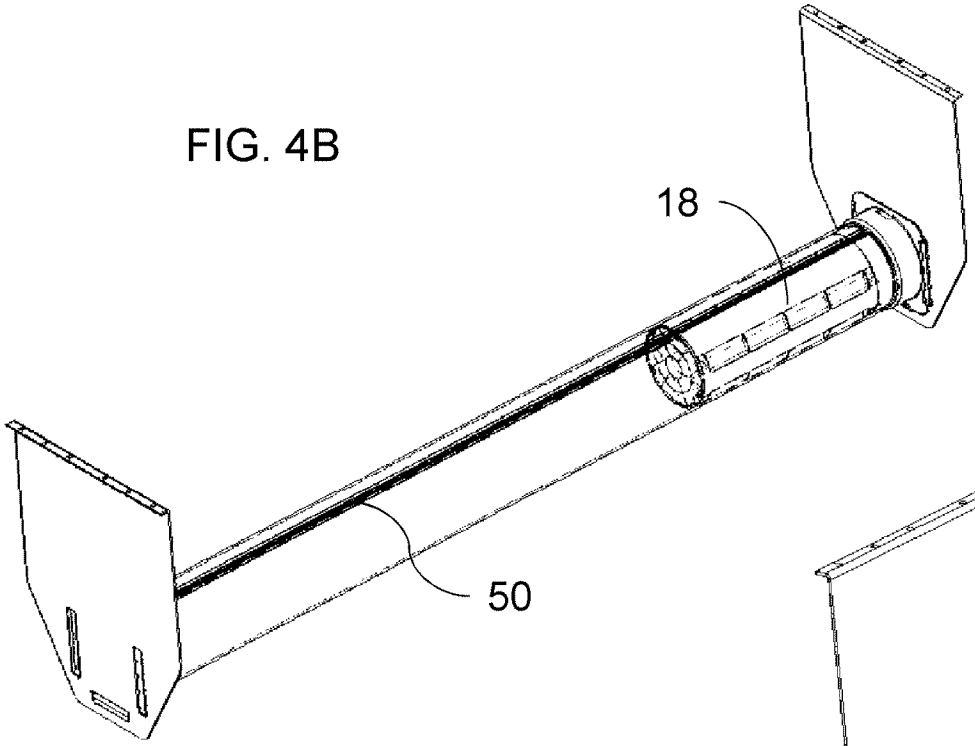
FIG. 4B is a view similar to FIG. 4A showing the pool cover winding system assembled in the end supports.
Figure 6:
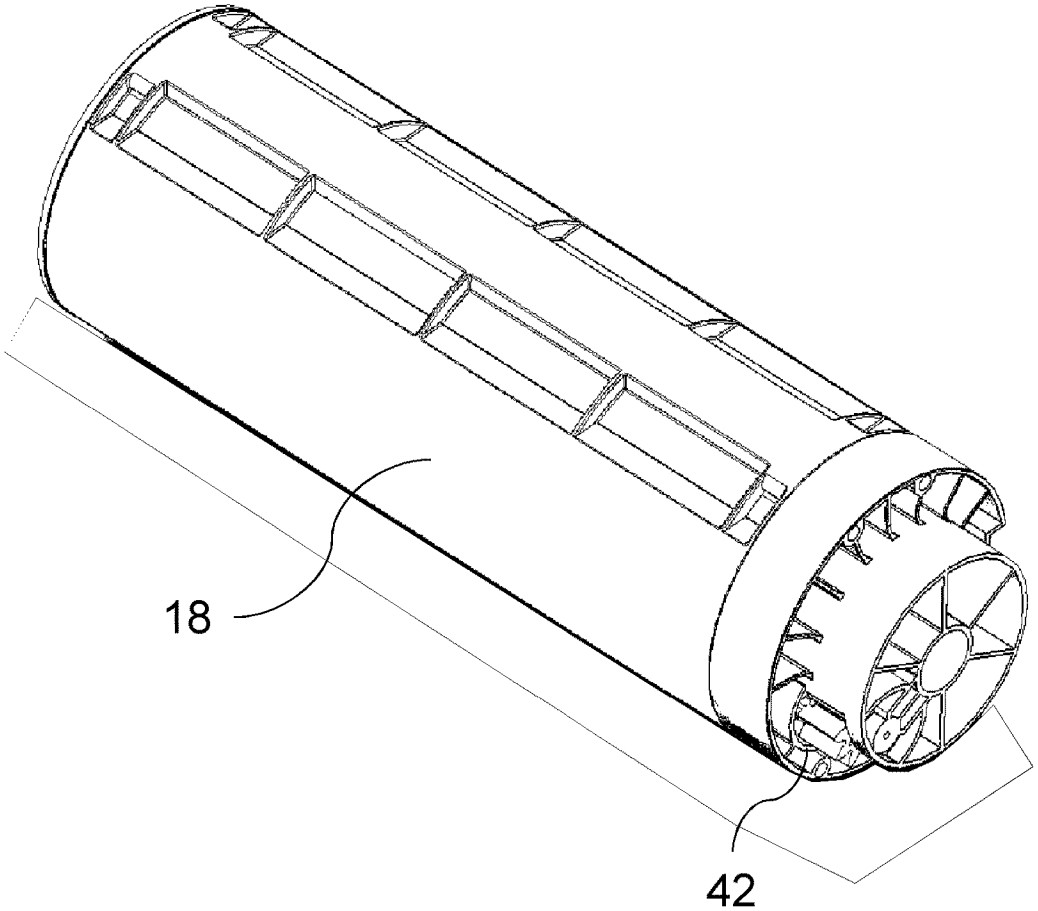
FIG. 6 is an isometric view of a water-driven piston motor, constructed and operative according to an embodiment of the present invention, for use in the winding system of FIG. 2A or FIG. 4A.

Mechanical engagement of motor 18 so as to rotate with shaft 14 may be achieved by forming a casing 46 of the motor with an elongated slot 48 (best seen in FIG. 8A) which is engaged by a corresponding inward ridge 50 of hollow shaft 14 (visible in FIGS. 2B, 4A and 4B). A suitable form of shaft 14 may advantageously conveniently be formed by extrusion, for example, from aluminum.

Figure 7:
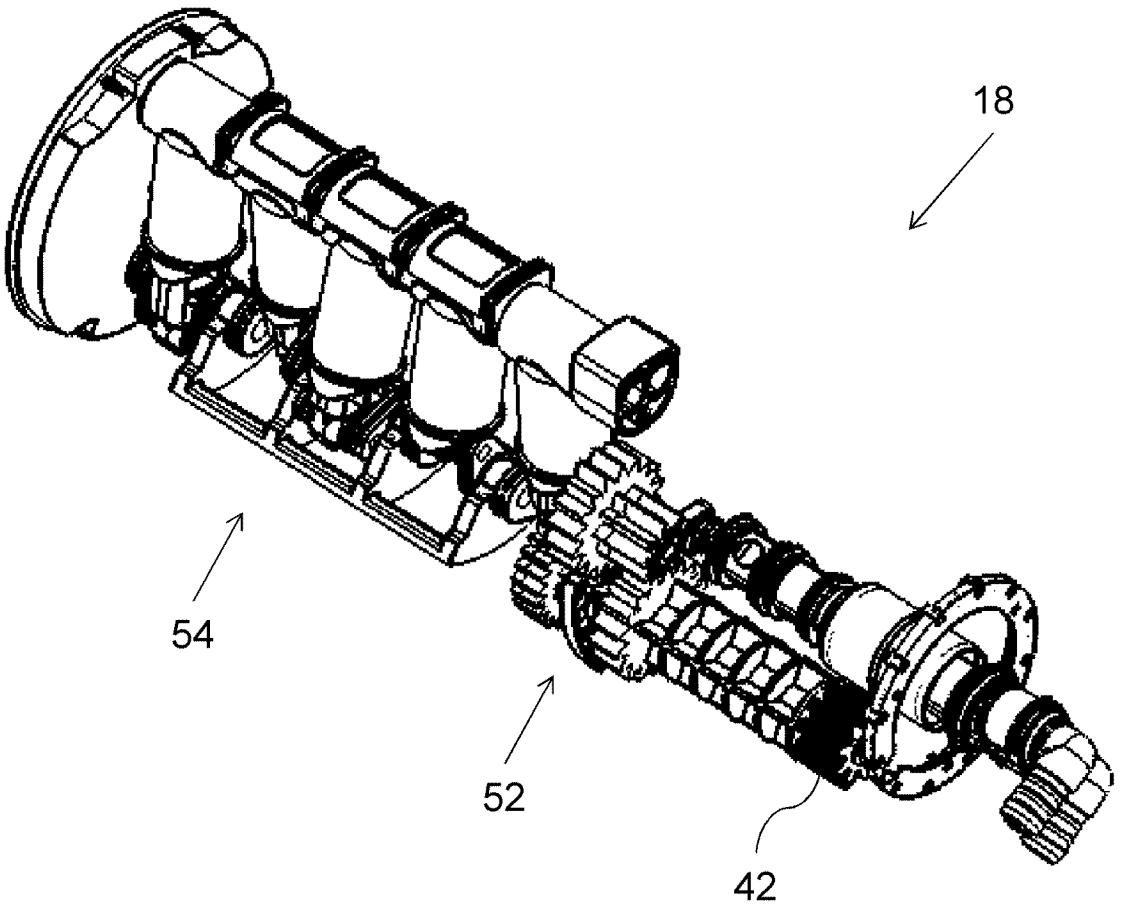
FIG. 7 is an isometric view of the motor of FIG. 6 with a cover removed to reveal inner components of the motor.
Figure 8:
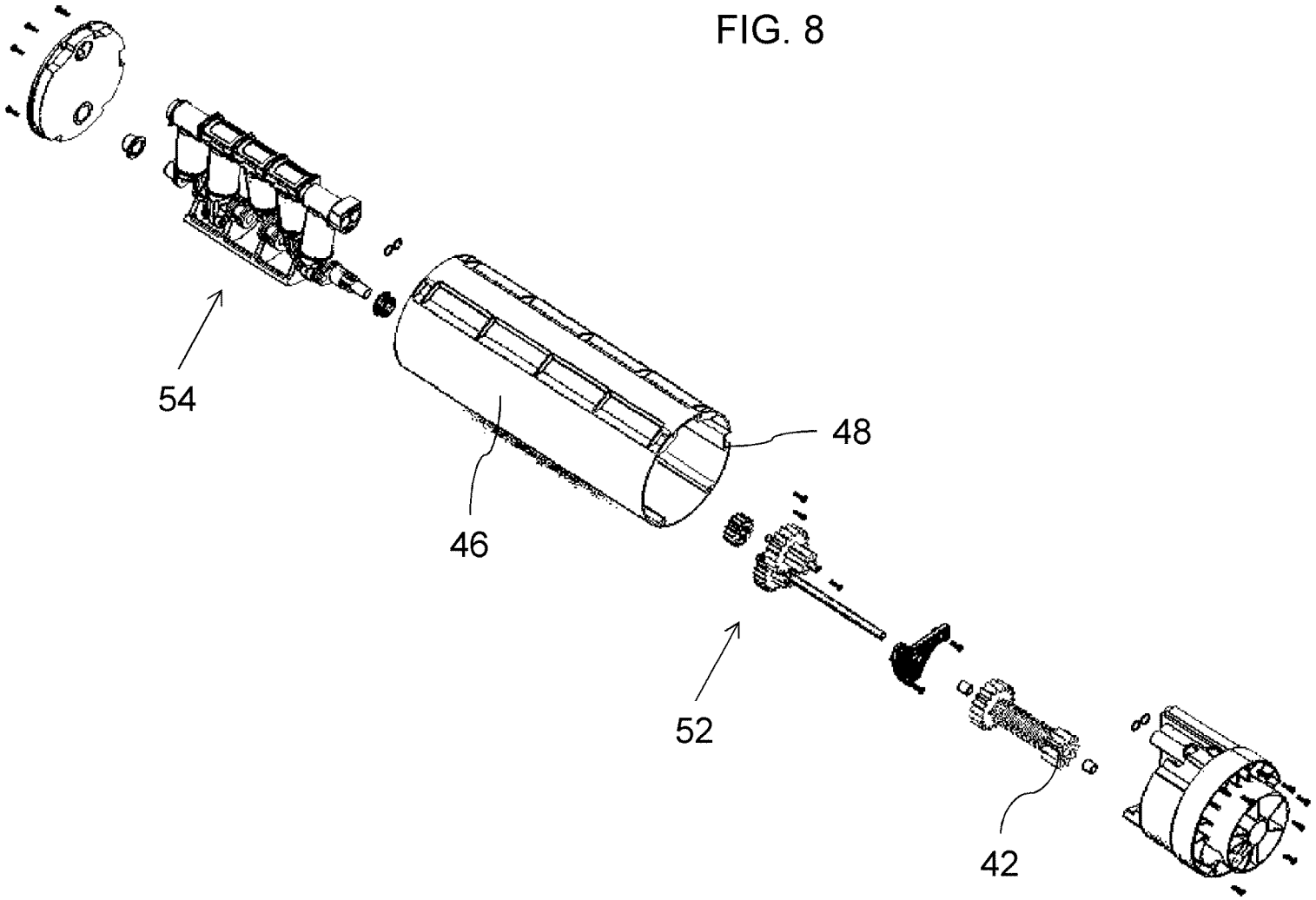
FIG. 8 is an exploded isometric view showing the components of the motor of FIG. 6.
Figure 9B:
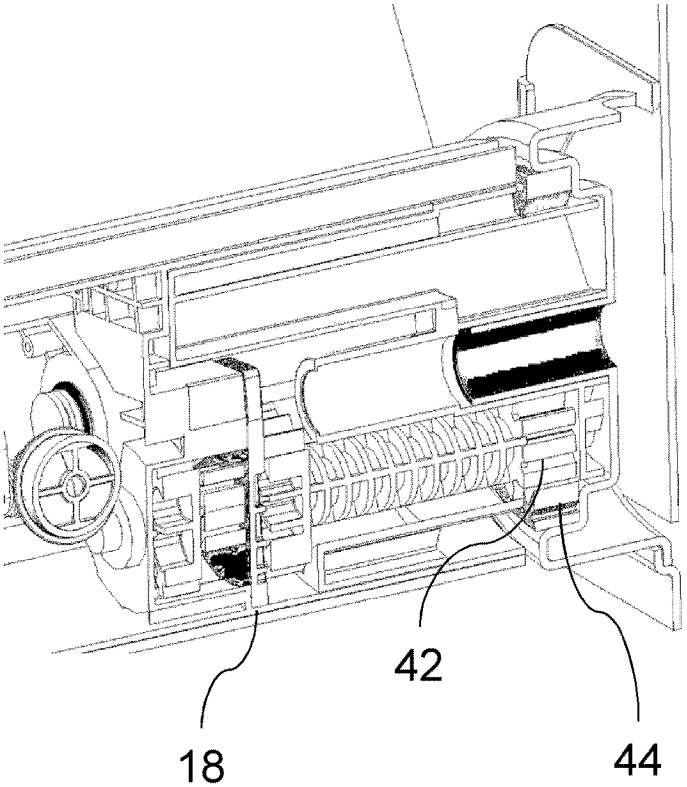
FIG. 9B is an isometric cut-away view revealing the last stage of the gear train of FIG. 9A corresponding to a driving relation between the output of the motor and a fixed gear of the end support.
Figure 9A:
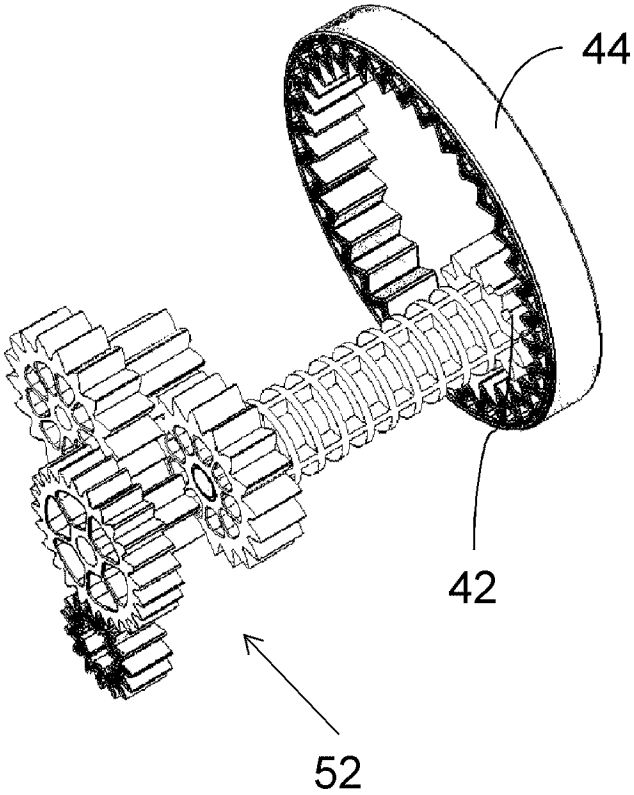
FIG. 9A is an expanded isometric view of a step-down gear train from the motor of FIG. 6.
Figure 10:
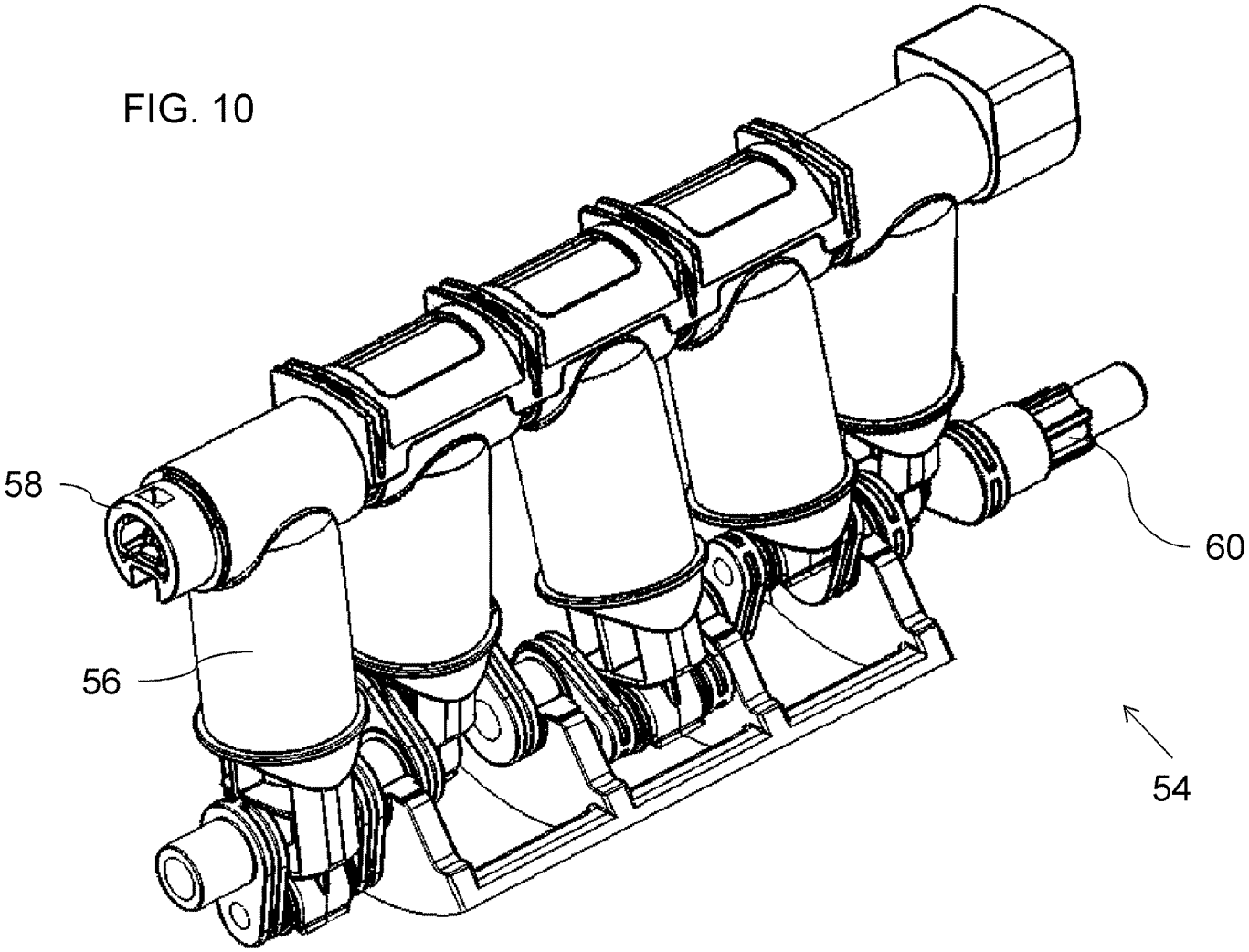
FIG. 10 is an isometric view of a water-driven piston drive assembly from the motor of FIG. 6.

For optimum operating conditions for motor 18 and to develop the required torque, output drive gear 42 is preferably the final gear of a step-down gear train 52, visible in FIGS. 7 and 8, and shown enlarged in FIG. 9A. In the non-limiting example illustrated here, the internal gear train has three step-down stages prior to output drive gear 42, and the engagement of output drive gear 42 with fixed gear 44 provides a further step-down stage, providing an overall step-down ratio of at least 20:1 between the direct motor crankshaft output and the rate of rotation of shaft 14. Clearly, the exact step down ratio may vary depending upon the motor specifications, and balancing considerations of the expected load for winding the cover and the desired speed of operation, all as will be clear to one ordinarily skilled in the art.

Figure 11A:
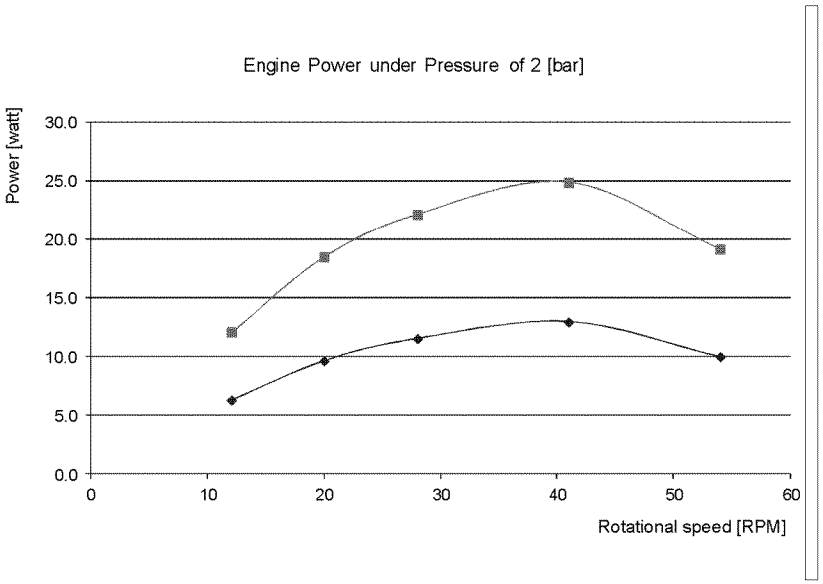
FIG. 11A is a graph showing typical power outputs as a function of rotational speed for piston drive assemblies having three and five pistons, respectively.
Figure 11B:
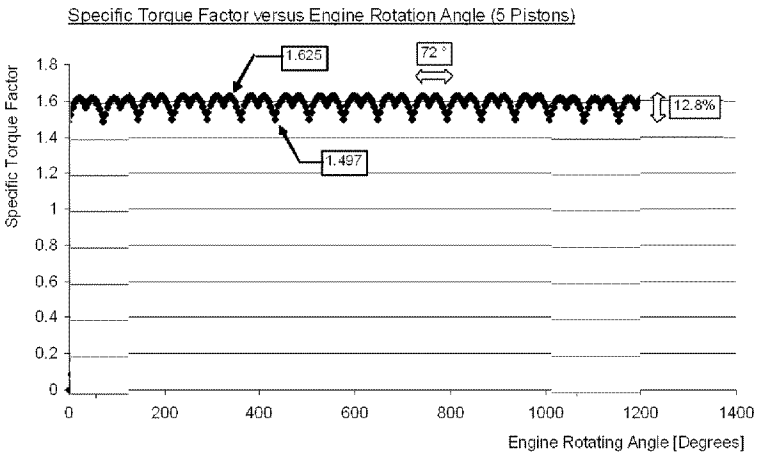
FIG. 11B is a graph showing the typical output torque of a five-piston drive assembly.

Motor 18 itself is preferably a bidirectional water-driven piston motor arranged with the pistons perpendicular to the longitudinal axis of shaft 14, so that a main output shaft of the motor rotates about an axis parallel to the longitudinal axis of shaft 14. Motor 18 may advantageously be implemented according to the teachings of U.S. Pat. No. 7,258,057 which is hereby incorporated by reference in its entirety as if fully set out herein. In order to achieve increased torque despite the very limited dimensions of the pistons which can fit in the limited form factor for insertion within shaft 14, the number of pistons is preferably increased above the 3-cylinder example illustrated in the aforementioned patent. Furthermore, in order to achieve a more uniform output torque as a function of angular position, it has been found advantageous to employ an odd number of cylinders. For this reason, a particularly preferred but non-limiting implementation of the invention employs a power unit 54 with five cylinders 56 pivotally mounted on a main water-flow manifold 58 and connected to a common crank shaft 60, as best seen in FIG. 7. FIG. 11A shows the estimated output power for a 3-cylinder and 5-cylinder power unit of this type, operating under a supply pressure of 2 atmospheres, as a function of rotational speed. FIG. 11B shows the variation in relative output torque as a function of angular position of the power unit for a 5-cylinder implementation. As seen, the torque varies cyclically with a period of 72 degrees, and varies within each cycle by roughly ±6% about its mean value.

As detailed in the aforementioned patent, the main water-flow manifold 58 provides water pressure input or drainage connection to each cylinder as a function of the angular position of the cylinder. For driving in the forward direction, each cylinder located to one side of center is connected to the pressurized water supply while each cylinder located to the other side of center is connected to the drainage line. When connections of the two water flow paths are reversed, pressure is provided to cylinders on the other side of center, thereby reversing the direction of operation of the motor. Remaining details of the power unit structure will be clear to one ordinarily skilled in the art by analogy with the teachings of the aforementioned patent.

Figure 12:
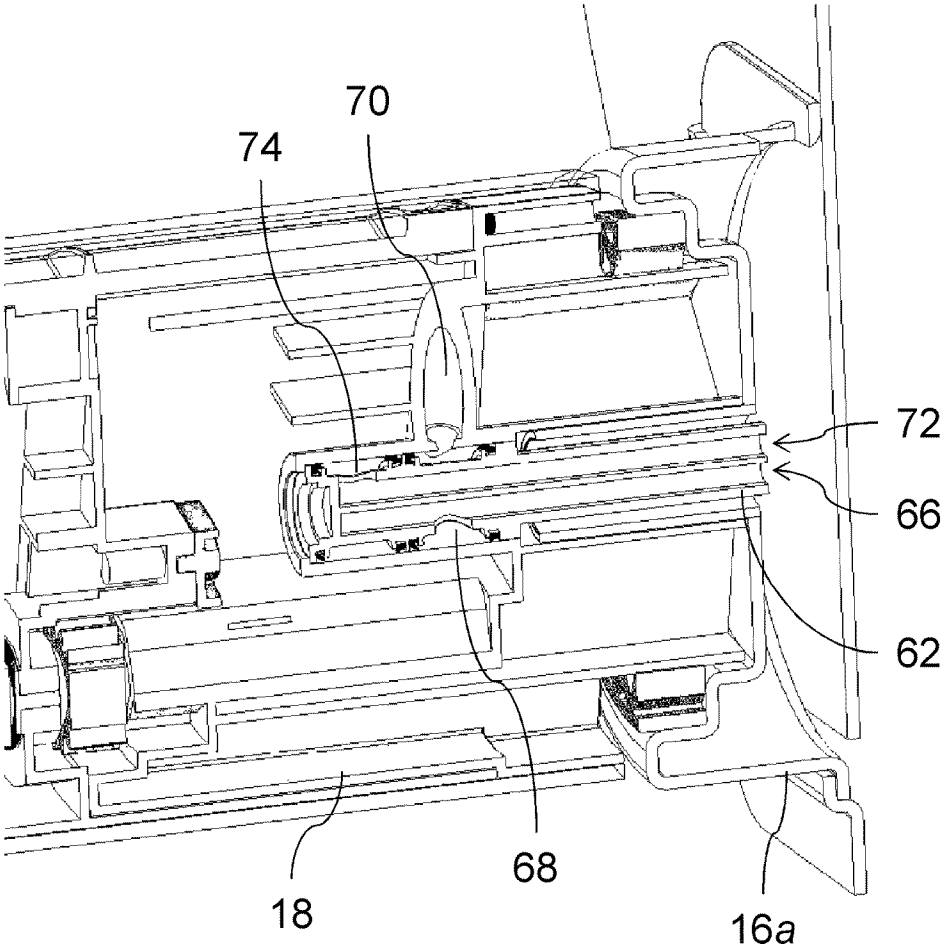
FIG. 12 is an axially cut-away isometric view illustrating an axial water feed for providing water pressure to the piston motor according to an embodiment of the present invention.

In the preferred example shown here in which the housing of motor 18 rotates together with shaft 14, the flow connections with valve arrangement 20 for both supply pressure and drainage must be preserved during rotation of the motor. A particularly preferred solution to achieve these rotatable connections will now be described with reference to FIG. 12.

Specifically, in the implementation shown here, the first end support 16*a* is provided with an axial water feed 62 (in fluid connection with valve arrangement 20 such as via supply hoses 64 shown in FIG. 13B) which extends into motor 18. Axial water feed 62 has a first water supply lumen 66 terminating in a first outlet 68 forming a rotatable fluid flow connection with the first inlet IN-1 of the motor, and a second lumen 72 terminating in a second outlet 74 forming a rotatable fluid flow connection with the second inlet of the motor (not visible in the cut-out view shown here). Outlets 68 and 74 are axially spaced from each other such that each forms a rotatable fluid flow connection that can rotate freely through multiple turns without one interfering with the other.

It will be appreciated that the above descriptions are intended only to serve as examples, and that many other embodiments are possible within the scope of the present invention as defined in the appended claims.

We claim:

1. A pool cover winding system comprising: (a) a shaft for receiving a pool cover wound around it; (b) first and second end supports that are stationary and are configured for supporting said shaft rotatably; (c) a bidirectional piston motor mechanically linked to said first end support and said shaft, said bidirectional piston motor being configured to operate under fluid pressure supplied to a first inlet to generate rotation in a first direction for winding a pool cover around said shaft, and to operate under fluid pressure supplied to a second inlet to generate rotation in a second direction for unwinding a pool cover from said shaft; and (d) a valve arrangement for selectively connecting a source of water pressure to each of said first and second inlets; wherein said shaft is at least partially hollow, and wherein said bidirectional piston motor is deployed primarily within said shaft;

wherein the bidirectional piston motor comprises cylinders and a main water flow manifold; wherein the main water-flow manifold is configured to provide water pressure input or drainage connection to each cylinder as a function of an angular position of the cylinder.

2. The system according to claim 1 wherein the main water flow manifold is configured to drive the bidirectional piston motor in the forward direction by connecting each cylinder located to one side of a center to a pressurized water supply while connecting each cylinder located to the other side of the center to a drainage line.

* * * * *